US007549612B2

(12) United States Patent
Manresa

(10) Patent No.: US 7,549,612 B2
(45) Date of Patent: Jun. 23, 2009

(54) DEVIATION SYSTEM FOR GUIDE MEANS USED IN A SET OF TOY VEHICLES

(75) Inventor: Luis M. Arnau Manresa, Barcelona (ES)

(73) Assignee: Winkler International, SA, Luxembourg (LU)

( * ) Notice: Subject to any disclaimer, the term of this patent is extended or adjusted under 35 U.S.C. 154(b) by 616 days.

(21) Appl. No.: 10/532,045

(22) PCT Filed: Oct. 22, 2002

(86) PCT No.: PCT/ES02/00499

§ 371 (c)(1),
(2), (4) Date: Oct. 4, 2005

(87) PCT Pub. No.: WO2004/037365

PCT Pub. Date: May 6, 2004

(65) Prior Publication Data

US 2006/0113429 A1 Jun. 1, 2006

(51) Int. Cl.
*A63H 19/00* (2006.01)

(52) U.S. Cl. ..... 246/415 A

(58) Field of Classification Search ..... 104/DIG. 1, 104/140, 304, 305, 60; 191/48; 463/62, 463/63; 246/415 A; 238/10 R, 10 A, 10 B, 238/10 E, 10 F; 446/455, 456, 444, 445, 446/446, 447

See application file for complete search history.

(56) References Cited

U.S. PATENT DOCUMENTS 1,355,467 A * 10/1920 Goodman ..... 246/382
1,671,236 A * 5/1928 Gill ..... 246/415 A
1,919,272 A * 7/1933 Caruso ..... 246/231
2,115,108 A * 4/1938 Horn ..... 104/305
2,325,471 A * 7/1943 Bonanno ..... 246/220
2,685,003 A * 7/1954 Barnes et al. ..... 191/48
3,290,498 A 12/1966 Lahr ..... 246/415
3,316,401 A * 4/1967 Cramer ..... 246/415 A
3,422,770 A * 1/1969 Celesia ..... 463/62
3,471,690 A * 10/1969 McRoskey et al. ..... 246/415 A
3,537,401 A * 11/1970 Metzner ..... 104/299
3,734,500 A * 5/1973 Cooper ..... 273/442

FOREIGN PATENT DOCUMENTS

| | | |
|---|---|---|
| EP | 0280920 | 9/1988 |
| EP | 0567296 | 4/1993 |
| FR | 2042168 | 2/1971 |

* cited by examiner

*Primary Examiner*—Mark T Le
(74) *Attorney, Agent, or Firm*—Nixon & Vanderhye, PC

(57) ABSTRACT

A toy vehicle and a track for the toy vehicle are designed to allow the toy vehicle to switch from one guide groove in the track to another based on a switching command. The track includes a fork in the guide groove, and a switch arm is pivotally mounted on the track at the fork. The toy vehicle includes a guide follower that extends into the guide groove of the track to guide the vehicle along the track. The guide follower includes a retractable switching member that can be selectively extended downwards into the guide groove. When the switching member is in a retracted position, the switch arm on the track remains in a first position so that the vehicle is guided along a first branch of the fork. When the switching member is extended downwards, it interacts with a cam profile on the switch arm to cause the switch arm to move to a second position. When the switch arm is in the second position, the vehicle is guided along a second branch of the fork.

13 Claims, 9 Drawing Sheets

DEVIATION SYSTEM FOR GUIDE MEANS USED IN A SET OF TOY VEHICLES

FIELD OF THE INVENTION

The present invention relates to a deviation system for guide means used in a set of toy vehicles, and more specifically to a deviation system for a set of toy vehicles of the type that consists of guide means formed by channels in a track way, and where the toy vehicles are driven by an electrical motor and are provided with a set of guide and dynamic current collector associated to the chassis and adapted to slide by the interior of the mentioned guide channel and to take power supply from electroconducting ways that flank said guide channel.

BACKGROUNDS OF THE INVENTION

It is well known in the state of the art the toy vehicle competitions in which, according to its more classical form and popular execution, the track way consists of at least two of said separated guide channels, each one for every vehicle, so that the vehicles can compete to each other. Each guide channel is flanked by two connected electroconducting tracks, through means for regulation the tension controlled by a player, to a power supply. In said way, each player can vary the speed of his vehicle on the track, regulating the tension provided to the tracks. Documents ES-A-1031830 and ES-A-1023869 make reference to competition games of adapted vehicles to run in said type of tracks. Nevertheless, with said configuration, each player controls his tracks but not his vehicle, and thus, in case that a vehicle of a player changes its guide to the neighbor's guide, it would be automatically controlled by the player who controls said neighbor's guide, and by said reason it would finish the competition.

U.S. Pat. No. 5,970,882 describes a game for toy vehicle competitions in tracks with guide channel, which includes deviations in the aforementioned channels. Nevertheless, there is two independent parallel circuits in the track, each one formed by a channel in which deviations and ramifications are arranged that come together in the same channel from which they have left and, although there are crossings, anyway one circuit is not communicated with another circuit. That is to say, it only admits a vehicle for each guide channel.

They are known in the state of the art deviations for toy vehicles, that move using sets of guide and dynamic current collector, such as electric trains and similar. The deviations here consist of the classical pivoted switch points and a mechanism of change of the switch points driven manually or by an actuator, as a solenoid, located next to the deviation. In said second case, the player can optionally send from the control post an order of change of the switch point usually transmitted through a specific conductive cable. Nevertheless, in said games of the type of the electric trains, all the rails, with their deviations, ramifications and confluences, are under a same control of the tension and, therefore, the vehicles can change one rail to another one without any problems. Two trains can circulate simultaneously by the same rail or by different rails connected to each other by deviations and confluences being both under the same speed control played by an only player. That is to say, it is not a speed competition game.

Also they are known in the state of the art some approaches to the subject of the speed control of different toy vehicles using an only one communication way.

Patent EP-A-0574634 describes a control system of a toy vehicle controlled by radio that circulates freely on a track surface. Said toy vehicle is controlled by means of operative commands transported by digital control signals that include an authentication code. Said allows to share an only radio channel for more than one vehicle, which is specially useful when, by some reason, there are not too many radio channels or when it is very expensive to make a tuneable communication system.

The object of the present invention is to provide a system of deviation for guide means used in a set of toy vehicles, in which means associated to the vehicle are able to drive or not to drive the change means of the switch point in a branching fork of said guide means before a guide follower of the vehicle reaches said branching fork, acting the mentioned means associated to the vehicle in response to a signal emitted from outside the vehicle.

BRIEF DESCRIPTION OF THE INVENTION

The previous objective is obtained, in agreement with the present invention, contributing a deviation system for guide means used in a set of toy vehicles, being said game of the type that consists of a trajectory determined by said guide means and at least a vehicle provided with a guide follower adapted to said guide means to follow said trajectory. The system comprises: at least one branching fork in said guide means from which one leaves a first and second branches; a switch point mounted in said branching fork so that it can move between a first position, in which said guide follower of the vehicle is forced to follow by said first branch, and a second position, in which the guide follower is forced to follow by the second branch; and an arm together joint to said switch point and provided with an contact end located upstream of said switch point, being said contact end capable of being pushed, when the vehicle passes, by an mobile member associated to the vehicle before the guide follower reaches the switch point. That is to say, it is the vehicle by its own, by means of said mobile member, that acts on said arm to change the switch point from said first position to said second position, or vice versa, determining which of the first or second branch is going to follow. The invention also comprises a control system, which is remotely used in order to actuate the above mentioned mobile member of the vehicle.

Although the invention is applicable to any set of toy vehicles that consists of guide means, for example, electric trains and similar, the examples of preferred embodiment are applied to vehicle competition games in which said guide means consist of a track surface for the vehicle in which there is at least a guide channel, branched off in first and second branches. Adjacent to side and side of said guide channel and of said first and second branches connected electroconducting tracks to an electrical power supply are foreseen. The mentioned vehicle consists of an electrical motor ready to drive one or more driving wheels that act on said track surface, and a set of guide and dynamic current collector in which it is included said guide follower, fin-shaped, adapted to slide by the interior of the mentioned guide channel and brushes connected to said motor and ready to take feeding electrical current from said electroconducting tracks at the same time that the vehicle moves. In said case, said switch point of deviation is arranged inside the guide channel, in the zone of the branching fork, and articulated so that it can pivot between said first and second positions with respect to a normal axis to said track surface. Said axis is located at the current end under the switch point, and some elastics means push said switch point towards to the mentioned first position. The mentioned arm is located below to the switch point and the contact end is in the trajectory of the guide groove and at a lower level than the level reached by said fin of the guide set and dynamic current collector of the vehicle inside the channel. The mentioned mobile member of the vehicle is a retractable member connected to actuating means placed over the vehicle, which are a part of said control system, to move said retractable member between retracted and extended positions. In the mentioned retracted position, the retractable member does not project lowerly from the vehicle to reach the contact end of the arm, with which, when the vehicle passes by the branching fork, the switch point remains in its first position. On the contrary, in the mentioned extended position, the retractable member projects lowerly from the vehicle to reach the contact end of the arm, with which, when the vehicle passes by the branching fork, the switch point is forced to its second position. The control system consists of, in addition, the transmitter means to transmit a specific signal of activation of said activation means and receiver means associated to the vehicle to receive said signal.

Advantageously, the retractable member is associated to the mentioned set of guide and the dynamic current collector of the vehicle, and more specifically, the retractable member is mounted in a passage of a sliding rod of the set of the guide and dynamic current collector and that crosses the fin so that, in its retracted position, is hidden in said passage and, in its extended position, it projects lowerly of the fin. Thanks to the fact that said rod is inserted in rotable way in a hole of the lower part of the vehicle, an upper end of the retractable member projects by the upper end of rod and from where it is driven by the actuation means.

Preferably, the electroconducting tracks are fed by predetermined constant tension and said signal transmitters and receiver means of the control system use for each vehicle multiplexing digital signals transmitted through a same channel, for example, through the electroconducting tracks (6*a*, 6*b*), although it is possible to transmit them, for example, through a same radio frequency channel. Said multiplexing digital signals include at least an authentication code of the vehicle, a command of speed regulation and a command of drive of actuation means. The transmitter means are arranged in an associated control to a vehicle controlled by a user. With said control system several vehicles can run simultaneously by anyone of the several guides interconnected by means of deviations according to the present invention, being each vehicle controlled independently by their respective player to regulate their speed and to take one or another branch in the deviations, which allows, for example, to carry out advancements. An equipment of suitable game to provide exciting competition between a two, three or more players includes, for example, a trajectory formed by several sections of track with two guide tracks interconnected by several branches of deviation and two, three or more automobiles with their respective controls.

BRIEF DESCRIPTION OF THE DRAWINGS

As follows, it will be described the present invention by an example of the embodiment in reference to the attached drawings, in which:

The FIG. 1A is a view in upper plant of a track surface with a channel and a branching fork provided with a system of deviation in agreement with a first example of the embodiment of the present invention, with the switch point in the first position, in where the switch point and the trajectory of the channel determined by the switch point in said first position are shaded for a better understanding;

Figure 1A:
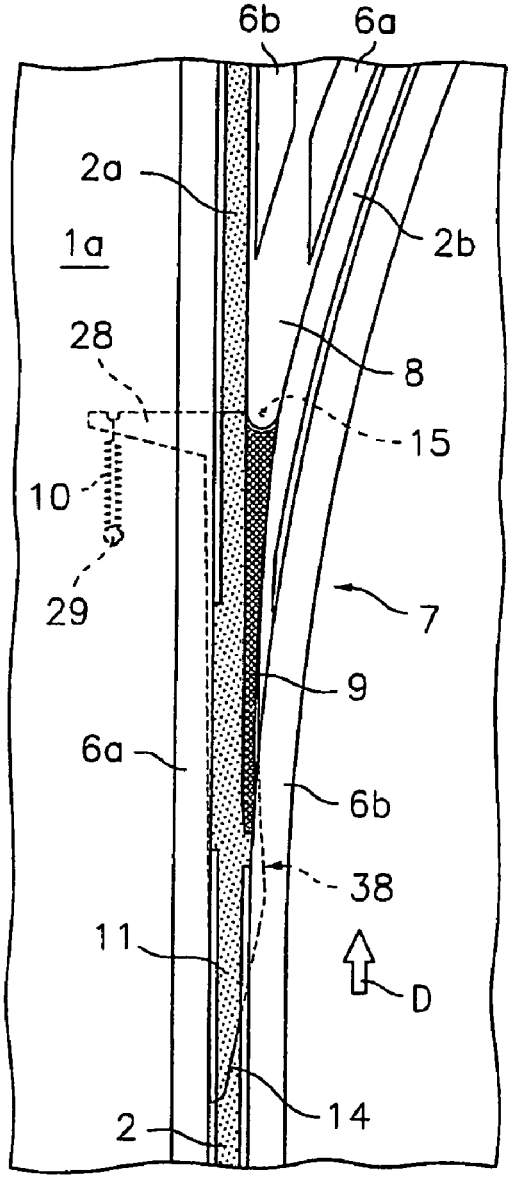
Figure 1B:
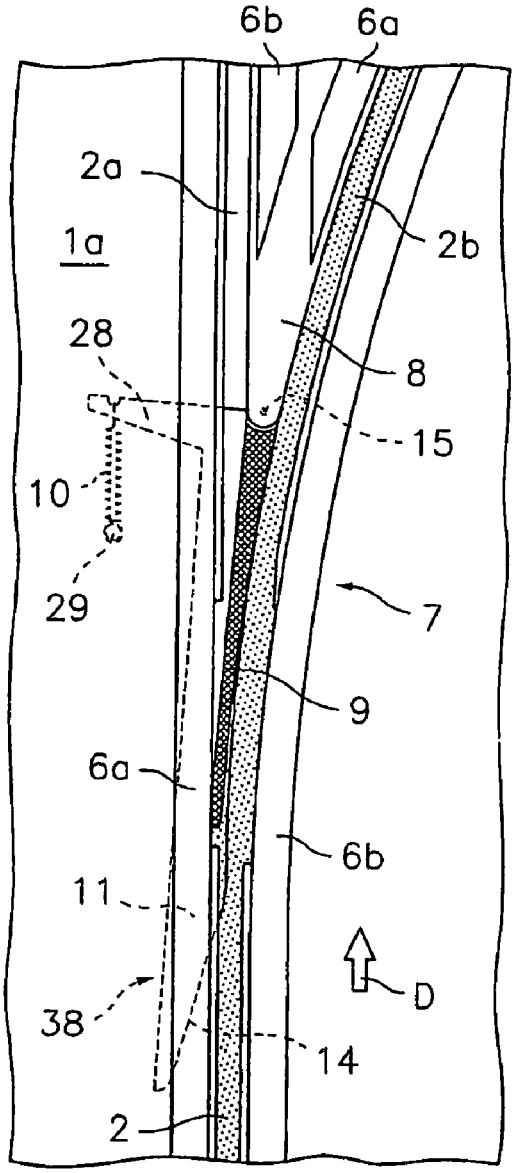
Figure 2:
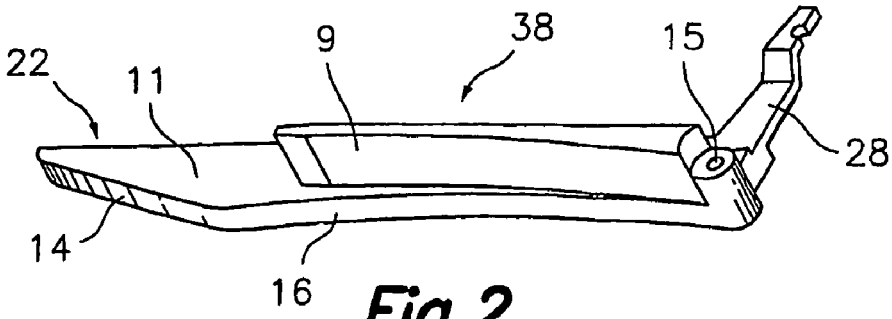
Figure 3:
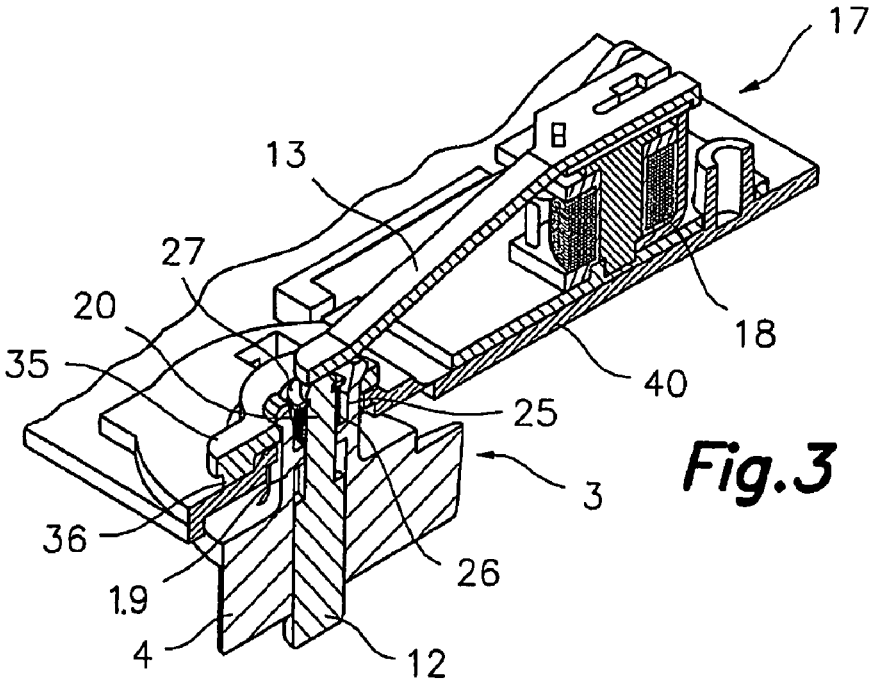
Figure 4A:
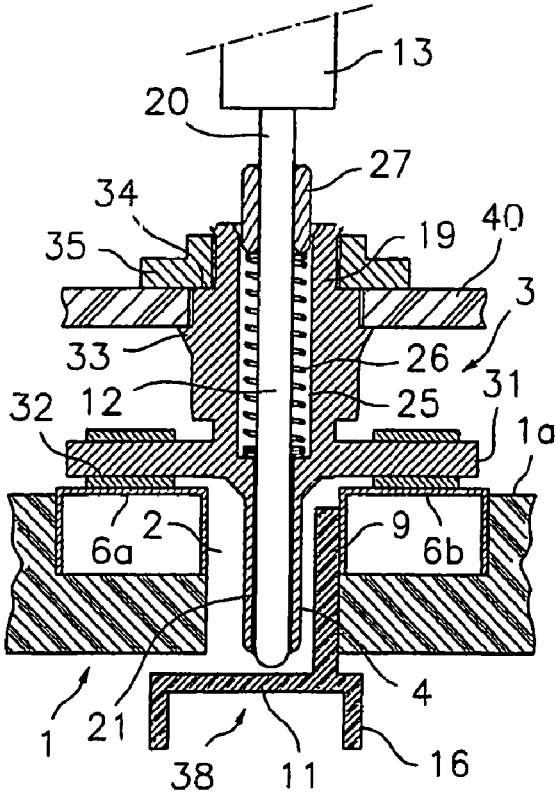
Figure 4B:
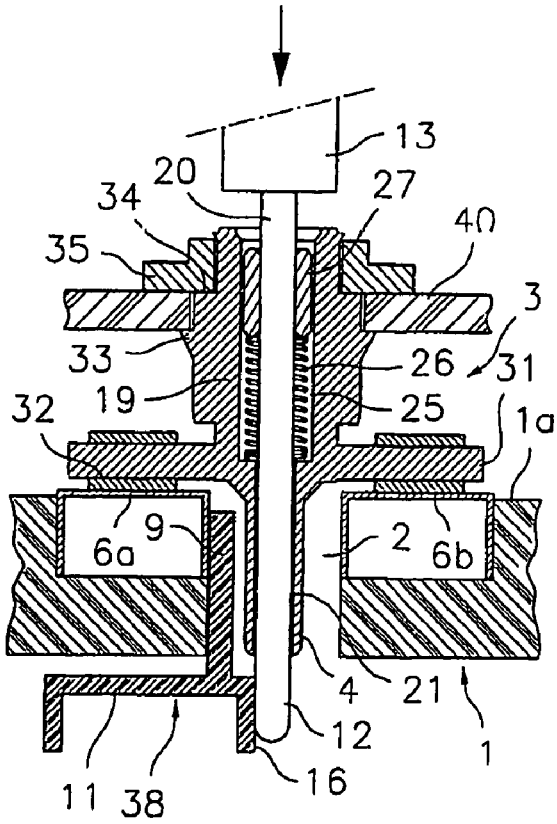
Figure 5A:
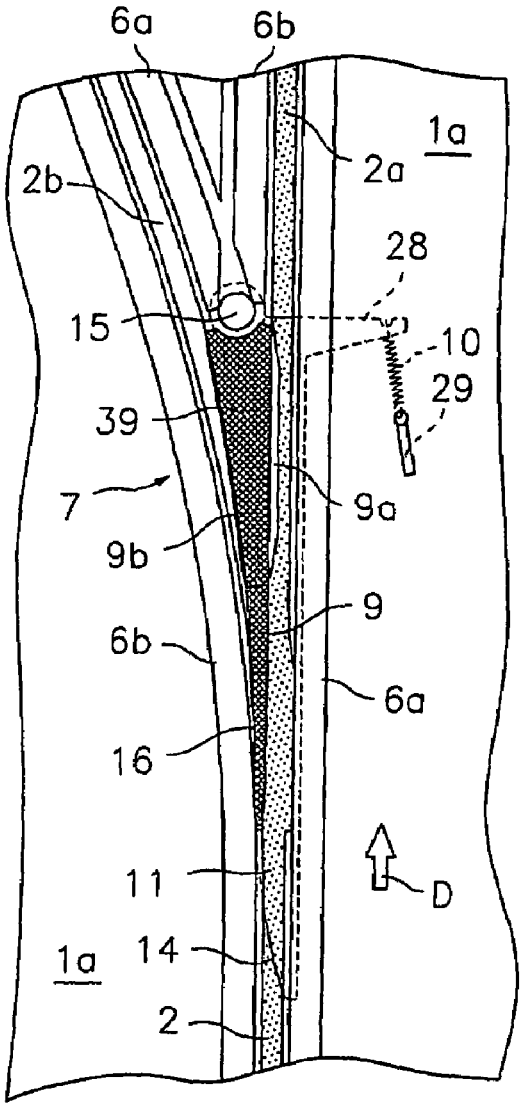
Figure 5B:
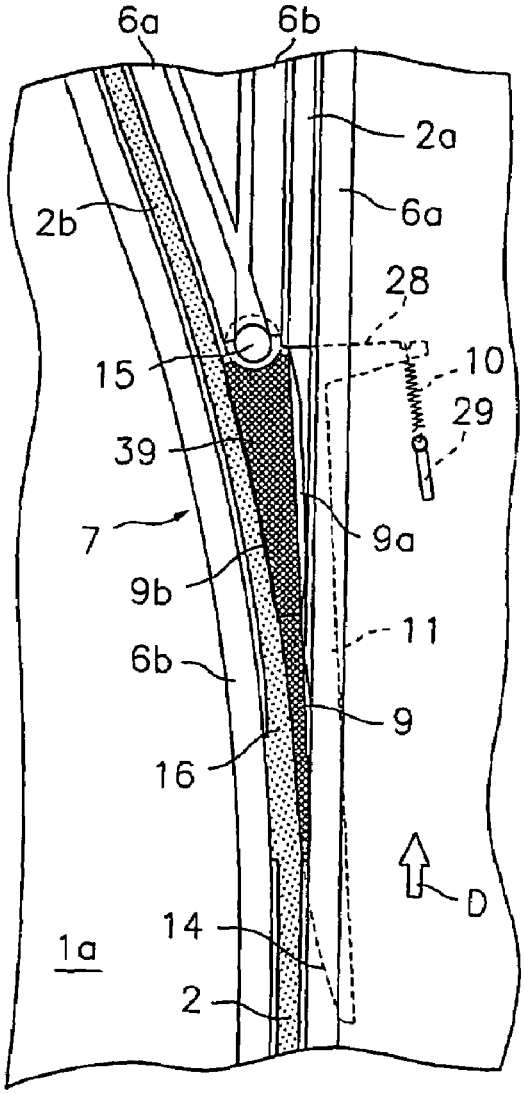
Figure 6:
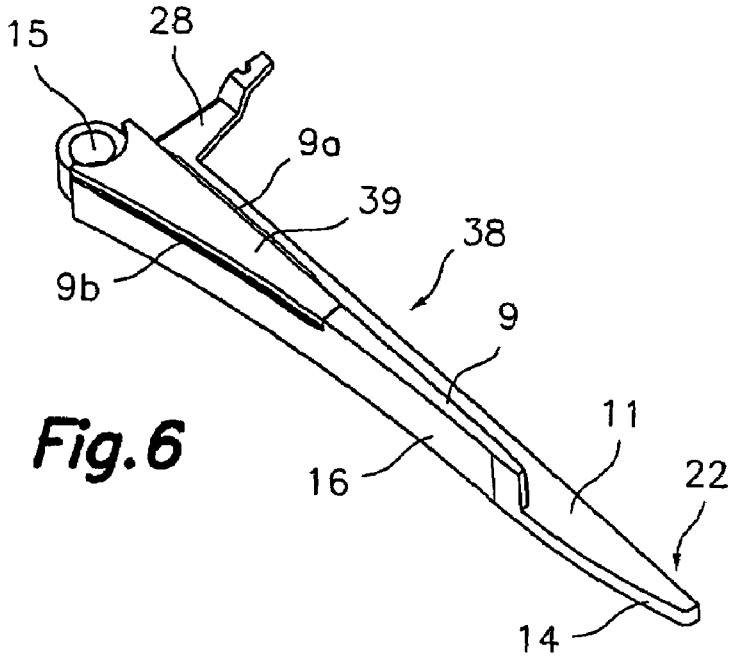
Figure 7:
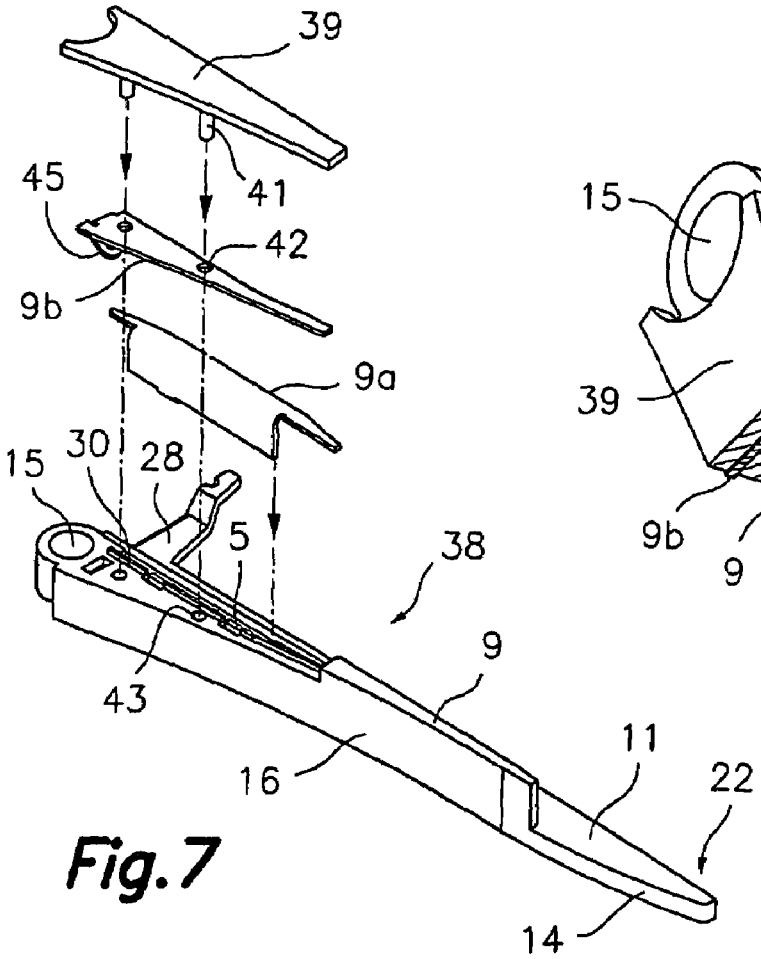
Figure 8:
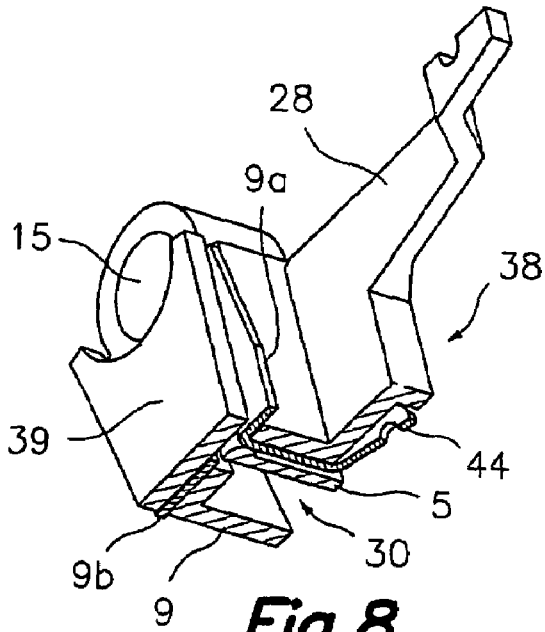
Figure 9A:
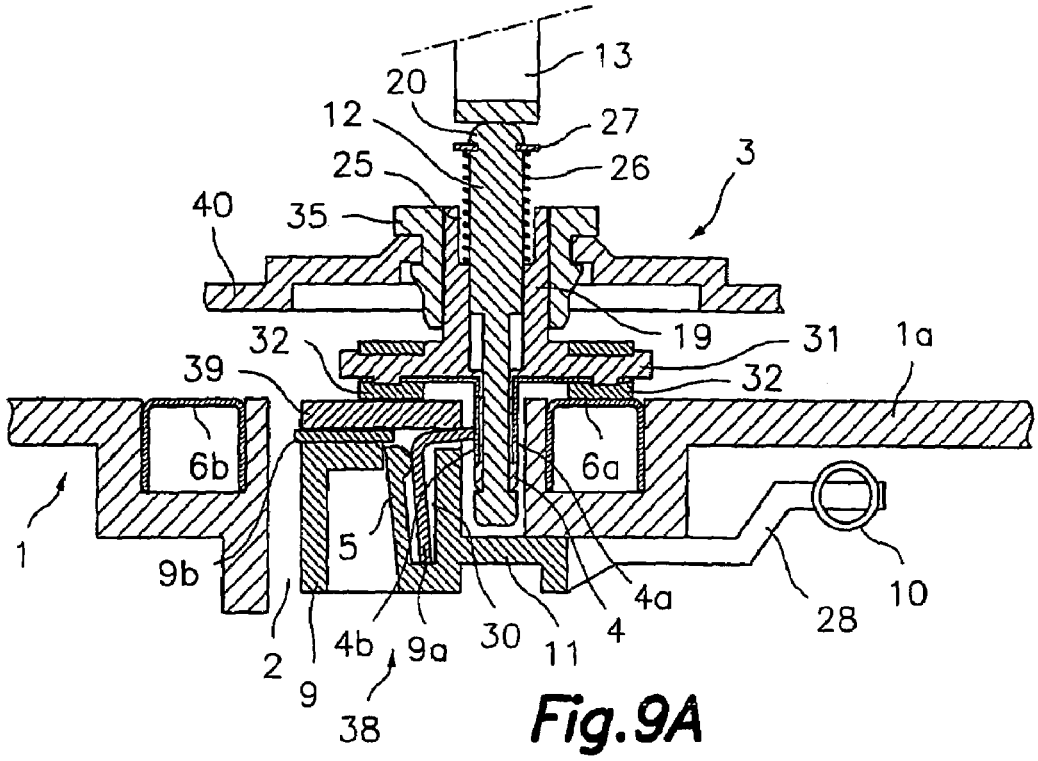
Figure 9B:
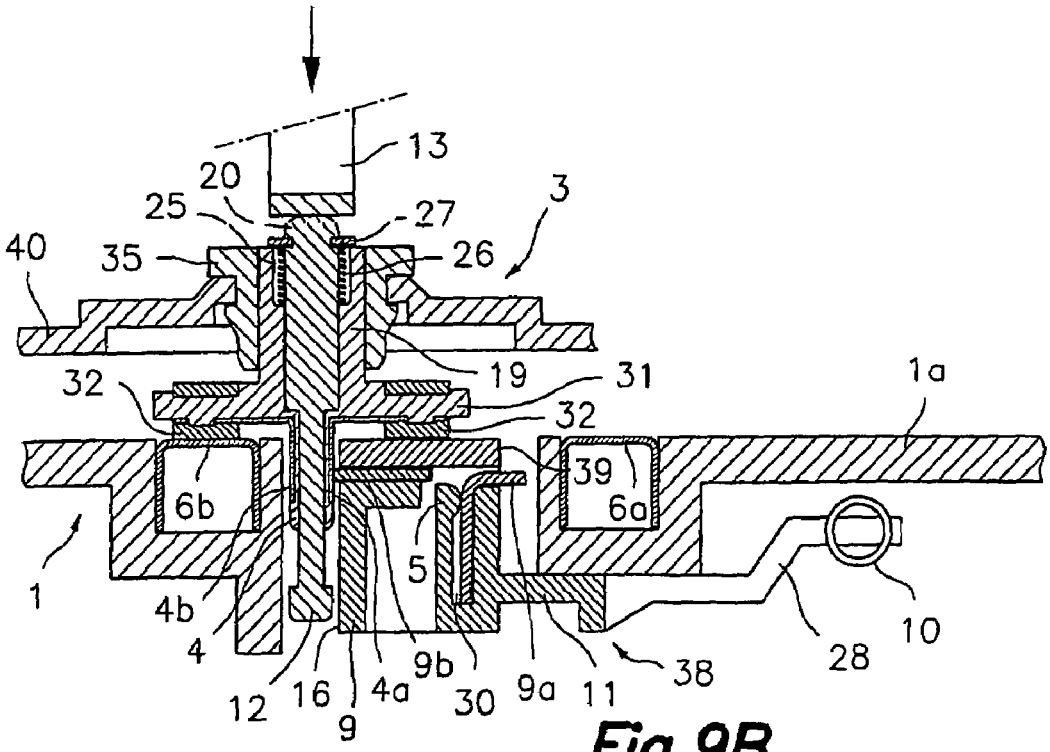
Figure 10:
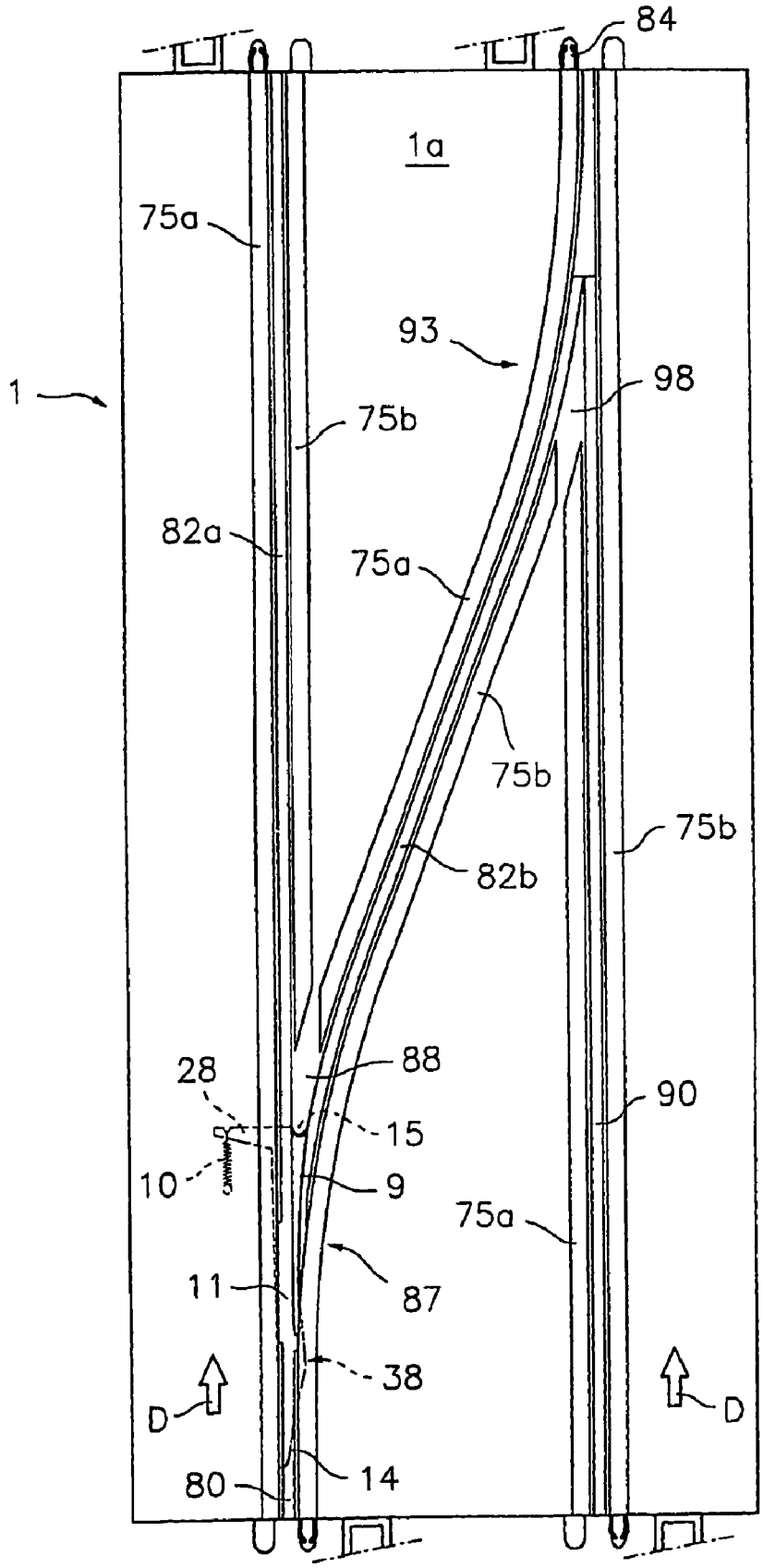
Figure 11:
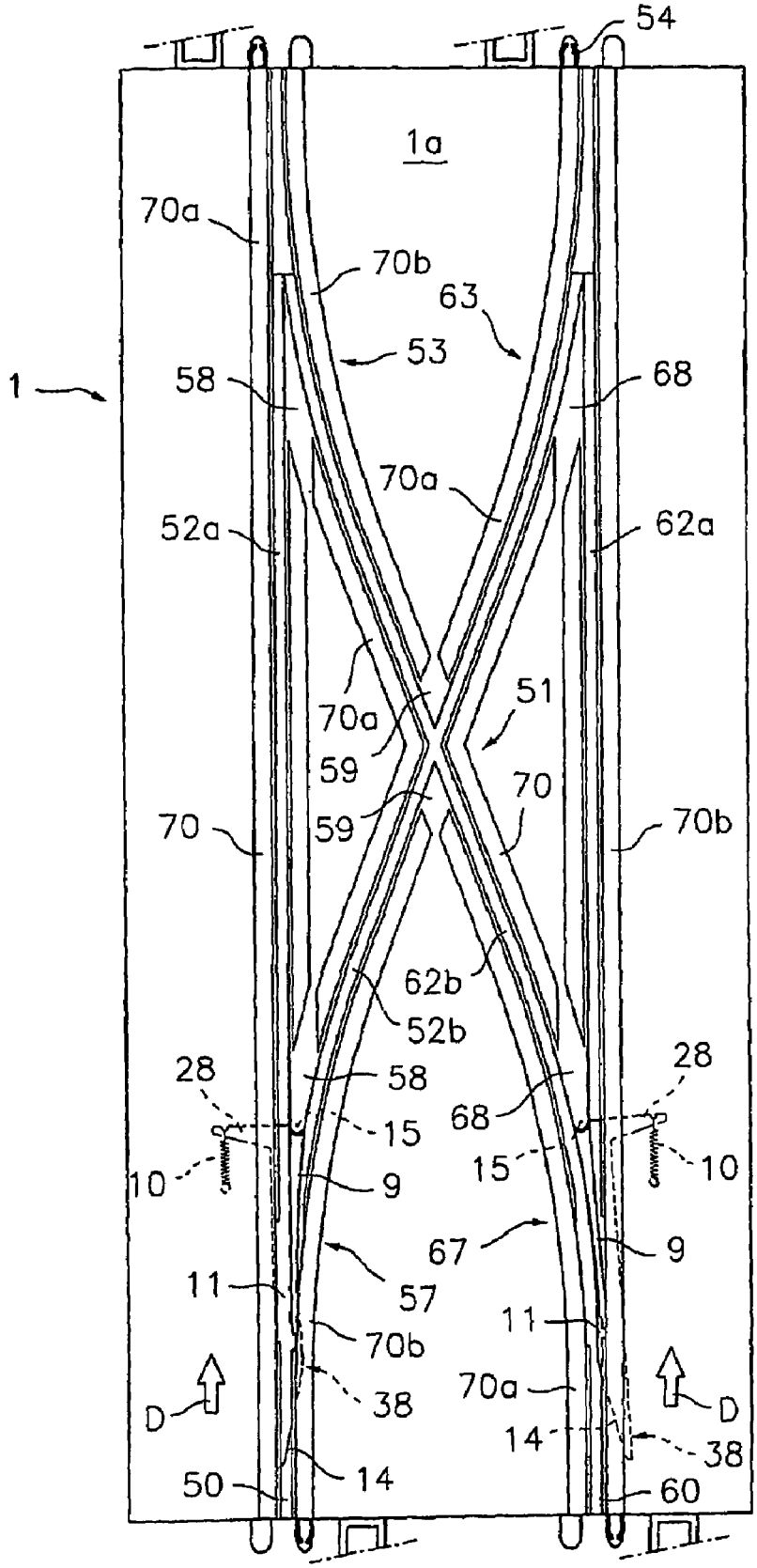
Figure 12:
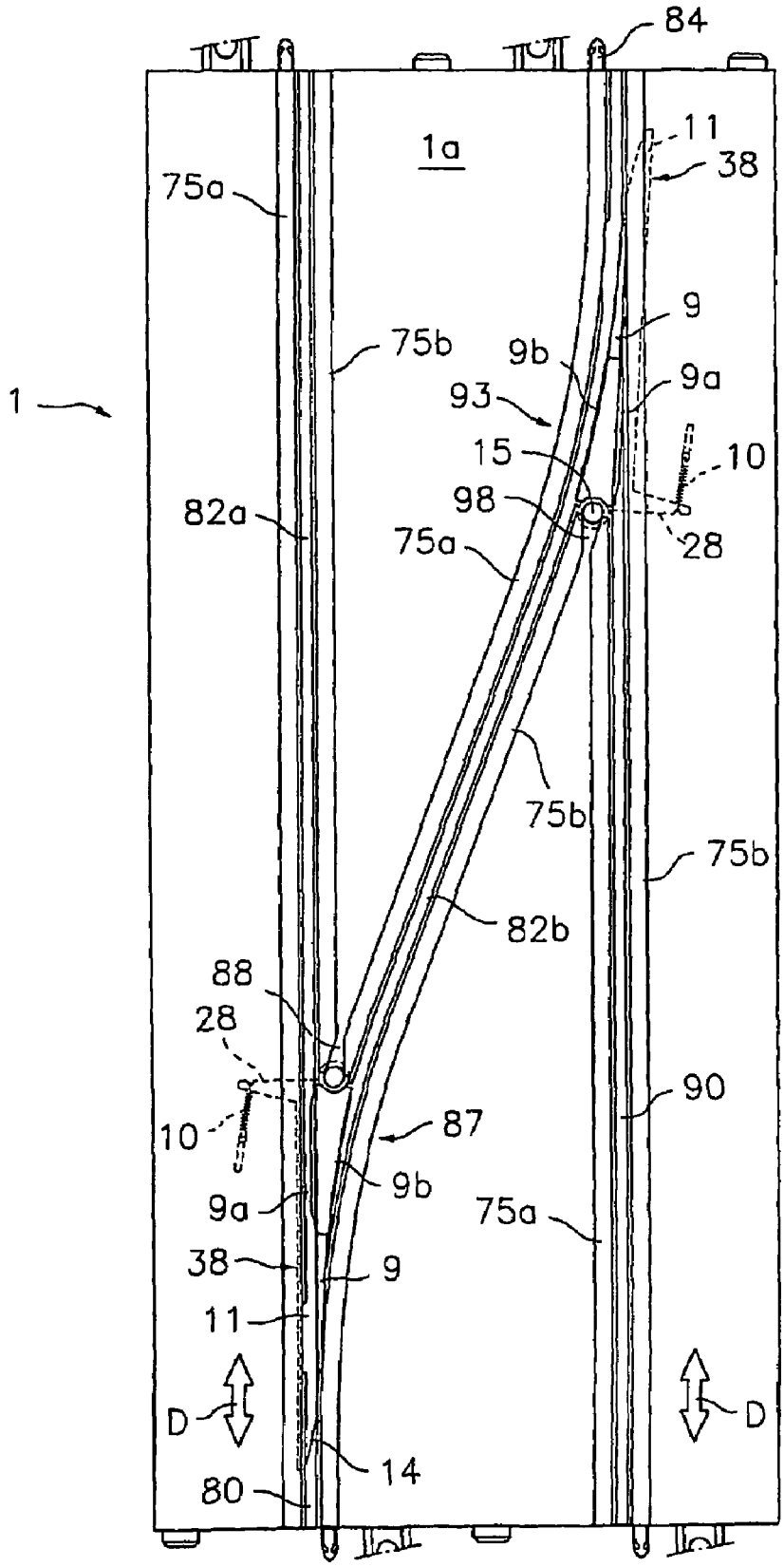
Figure 13:
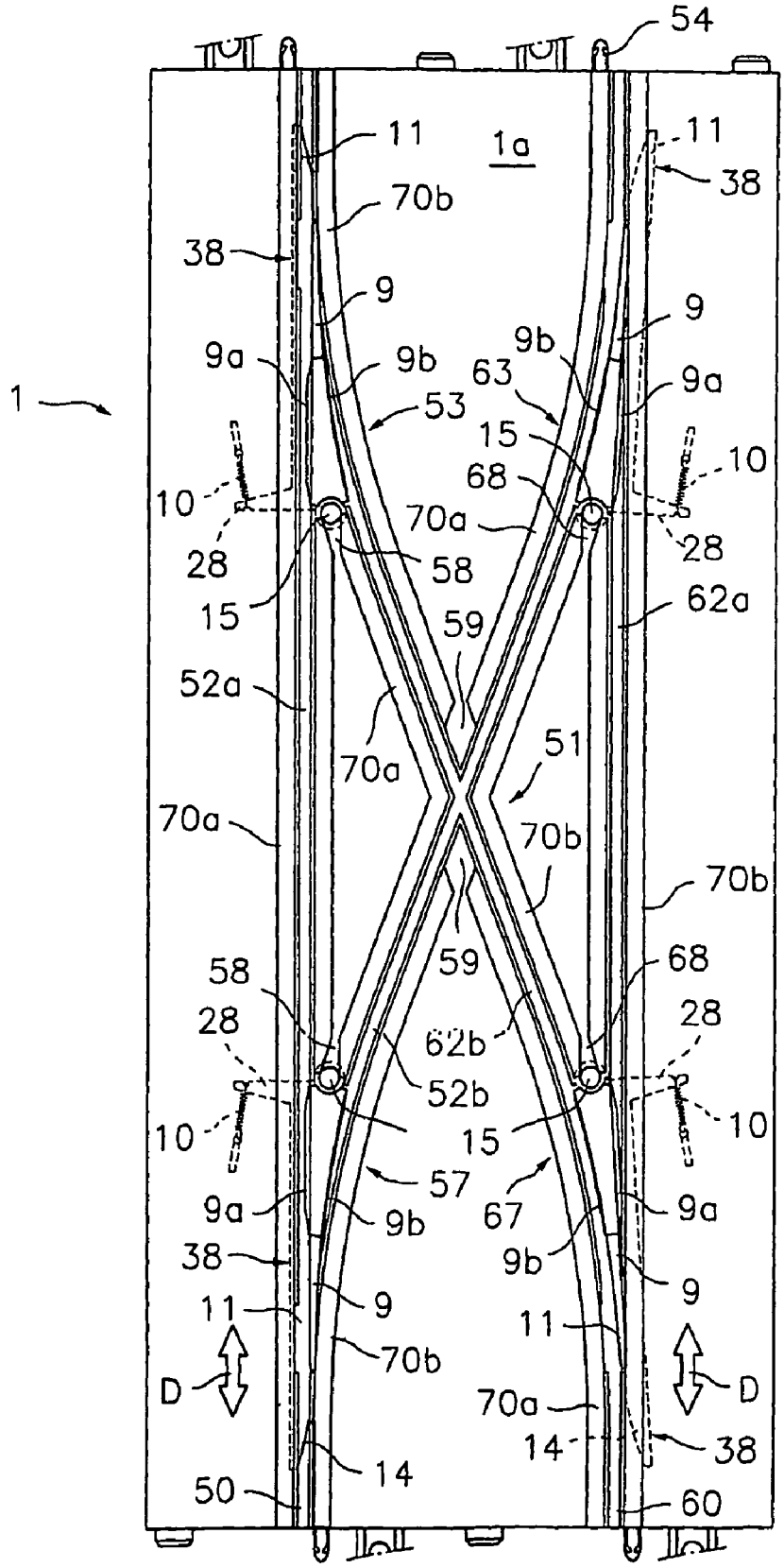

The FIG. 1B is a view in upper plant similar to the one of the FIG. 1A but with the switch point in the second position, in where also the switch point and the trajectory determined by the same one are shaded;

The FIG. 2 is a perspective view that shows a body that includes the switch point of the FIGS. 1A and 1B, along with an arm that defines cam profile and a lever arm;

The FIG. 3 is a partial view in sectioned perspective by half of the guide set and dynamic current collector according to the first example of the embodiment of the invention connected to a lower part of the vehicle and with the retractable member on extended position actuated by the actuation means;

The FIG. 4A is a view in cross-sectional section that shows the set of guide and dynamic current collector of FIG. 3 with the retractable member in the retracted position and in relation to the guide means of the FIGS. 1A and 1B in the zone of the branching fork, where the switch point is in its first position;

The FIG. 4B is a view in cross-sectional section that shows the set of guide and dynamic current collector of FIG. 3 with the retractable member in the extended position and in relation to the guide means of the FIGS. 1A and 1B in the zone of the branching fork, where the switch point is moved and kept in its second position by the retractable member;

The FIGS. 5A and 5B are similar views to those of the FIGS. 1A and 1B, but in agreement with a second example of the embodiment of the invention, in which the body that includes the switch point and in addition the arm includes contact elements in the sides of the switch point to make up for interruptions in the electroconducting tracks in the zone of the branching fork;

The FIG. 6 is a perspective view that shows the body that includes the switch point with flank contact elements in the branching fork of the FIGS. 5A and 5B;

The FIG. 7 is an exploded perspective view of the body of FIG. 6;

The FIG. 8 is a sectioned perspective view of the body of FIG. 6;

The FIGS. 9A and 9B are cross-sectional views similar to those of the FIGS. 4A and 4B but in which the branching fork includes the body of FIG. 6 and the set of guide and dynamic current collector of the vehicle refers to said second example of the embodiment of the invention, in that the fin includes flank contacts;

The FIG. 10 is a view in upper plant of a track section that it includes first and second grooves of guide with a branching fork from which it starts a branch that is connected with the second guide groove in a confluence, being included the first example of the embodiment of the system of deviation of the invention shown in the FIGS. 1A and 1B in said branching fork;

The FIG. 11 is a view in upper plant of a track section that it includes first and second grooves of guide with individual branching forks from which they start respective branches that are crossed and are connected downstream with the second and first grooves of guide in respective confluences, being incorporated the first example of the embodiment of the system of deviation of the invention shown in the FIGS. 1A and 1B in both branching forks;

The FIG. 12 is a view in upper plant of a section of the track similar to the one of the FIG. 10 but in which it is included the second the example of the embodiment of the system of deviation of the invention shown in the FIGS. 5A and 5B as much in said branching fork as in said confluence; and The FIG. 13 is a view in upper plant of a section of track similar to the one of the FIG. 11 but in which it is included the second example of the embodiment of the system of deviation of the invention shown in the FIGS. 5A and 5B as much in both branching forks as in both confluences.

CONCRETE EMBODIMENT OF THE APPLICATION

Referring, first of all, to the FIGS. 1A and 1B, in them it is shown a track surface with a guide channel 2 and electroconducting tracks 6*a*, 6*b* associated to side and side of the guide channel 2. Said electroconducting tracks 6*a*, 6*b* are connected to the opposed polarities of a DC power supply. On the mentioned track surface 1*a* some toy vehicles move (not shown), which are of the type that essentially consists of a frame or chassis in which it is mounted an electrical motor arranged to drive at least an axis connected to drive wheels in contact with the track surface 1*a*. In a front zone of the frame or lower part of the vehicle it is mounted a set of guide and dynamic current collector 3 (see the FIGS. 3, 4A and 4B) provided with a fin 4 adapted to slide by the interior of the mentioned guide channel 2 and brushes 32 to take feeding electrical dynamically current from said electroconducting tracks 6*a*, 6*b* associated to said guide channel 2.

The guide channel 2 includes a branching fork 7 from which start a first and second branches 2*a*, 2*b*. Those of said electroconducting tracks 6*a*, 6*b* that located in the opposed sides of the guide groove 2 have continuity in the electroconducting tracks 6*a*, 6*b* located in the most faraway sides of the branches 2*a*, 2*b*, whereas respective sections of electroconducting tracks 6*a*, 6*b* start without contact in the proximities of branching fork 7 and they extend downstream in the sides closest to the branches 2*a*, 2*b*. Since the electroconducting tracks 6*a* and 6*b* have opposed polarities, the same ones have interruptions 8 in the zone of branching fork 7 with the purpose of avoiding a contact among them, which would produce a short circuit. It is necessary to indicate that in the FIGS. 1A and 1B, as well as in the other figures attached to this description, the direction in which the toy vehicles move on the track surface 1*a* has been indicated by means of an arrow D.

Within the guide channel 2, in the zone of branching fork 7, a switch point 9 is mounted so that can pivot with respect to a normal axis 15 to the track surface 1*a*. Thanks to this, switch point 9 is capable of pivoting between first and second positions. For a greater clarity, switch point 9 is shaded in said first and second positions in the FIGS. 1A and 1B, respectively. The mentioned first position is in the FIG. 1A and in it the switch point 9 is attached to a side (the right side in the figures) of the guide channel 2, so that said fin 4 of the set of guide and dynamic current collector 3 of the vehicle is forced to follow by the first branch 2*a*. The second position of the switch point 9 is in FIG. 1B and in it the switch point is attached to the opposite alongside (the left side in the figures) of the guide channel 2, so that fin 4 of the set of guide and dynamic current collector 3 of the vehicle is forced to also follow by the second branch 2*b*. Also, for a greater clarity, the trajectories qualified by the combinations of the guide channel 2 respectively with first branch 2*a* (FIG. 1A) and with the second branch 2*b* (FIG. 1B) are shaded.

Elastic means 10 push said switch point 9 towards the mentioned the first position whereas a connected arm 11 to switch point 9 is pushed selectively by a retractable member 12 associated to the vehicle to locate the switch point 9 in the second position during a sufficient time so that the fin 4 is forced to follow by the second branch 2*b*. Mentioned retractable member 12 is capable of being moved by the activation means 17, 26 mounted on the vehicle in response to a specific signal of drive emitted by transmitter means external to the vehicle and received by receiver means of said signal associated to the vehicle. Preferably, the electroconducting tracks are fed to a predetermined constant tension and the mentioned specific signal of drive of said activation means 17 consists of a digital signal with a specific authentication code of a specific vehicle, a command of speed regulation and a command of drive of actuation means, being said signal divided or multiplexed and transmitted to the mentioned receiver means associated to the vehicle through the electroconducting tracks 6*a*, 6*b*. The mentioned transmitter means are associated to a control controlled by a user.

The movement of the retractable member 12 takes place between a retracted position, in which, when the vehicle moves through said branching fork 7, retractable member 12 does not interact with said arm 11 (seen at the FIG. 4A), reason why switch point 9 remains in his first position, and an extended position, in which, when the vehicle moves through branching fork 7, retractable member 12 interacts with arm 11 before said fin 4 has reached switch point 9 (it see the FIG. 4B), forcing with that to switch point 9 to its second position.

In agreement with the illustrated example of the embodiment, said retractable member 12 is associated to the mentioned set of guide and dynamic current collector 3 of the vehicle and, in its extended position, extends towards the interior of the guide channel projecting beyond the depth of the fin 4. The set of guide and dynamic current collector 3 with retractable member 12 are described later in relation to the FIGS. 3 to and 4A-B.

On the other hand, in FIG. 2 a body 38 is in detail that integrates the mentioned arm 11, switch point 9, and in addition an arm to lever 28 that starts laterally from a zone next to a housing for the axis 15. Arm 11 is attached to a lower part of the switch point 9 and consists of, in a contact end 22 distal of the mentioned axis 15, a cam profile 14 which, when switch point 9 is in its first position (FIG. 1A), has left in the trajectory of the guide channel 2 and a lower level to which the fin 4 reaches in the guide channel 2, but upper to the one that the retractable member 12 reaches in its extended position. The cam profile 14 has a suitable inclination so that when, in use, the cam profile 14 is pushed by retractable member 12 in their extended position, body 38 is moved to change the switch point 9 from the first to the second position, and it is to a distance of the switch point 9 so that it causes that said one has reached its second position (FIG. 1B) before the fin 4 has reached to the same one. The cam profile 14 extends in a guide profile 16 placed along the arm 11 to maintain the switch point 9 in its second position during the full movement of the vehicle by said branching fork 7 by the contact of the retractable member 12, in its extended position, with said guide profile 16.

The mentioned lever arm 28 and a part of the arm 11 are located in a lower face of the track surface 1*a*. In the distal end of the lever arm 28 said elastic means are applied, which consists of, for example, a draft spiral spring 10 with an end fixed to a projection 29 placed in said lower face of the track 1 and another end fixed to said lever arm 28.

In the FIGS. 3 and 4A-B it is demonstrated the set of guide and dynamic current collector 3 provided with a retractable member 12. The said set of guide and dynamic current collector 3 consists of a piece that defines a fin 4 destined to follow the guide channel and the rod 19 inserted in a hole of the lower part 40 of the vehicle, with which the set is fixed to the vehicle so that it can pivot. Retractable member 12 is housed of sliding track in an existing passage 21 in the fin 4 and that extends by the centre of said rod 19, so that an upper end 20 of the retractable member 12 projects by the upper part of rod 19. Mentioned passage 21 has a widened portion 25 next to its upper end in which an elastic element is housed, as a compression spiral spring 26, retained by a fixed top 27 to retractable member 12. Said spring 26 pushes the retractable member at any moment towards its retractable position and it is a part of the actuator means 17, 26, which consist of, in addition, a lever 13 driven by an actuator, as a solenoid 18. An end of said lever 13 is capable of pressing against said upper end 20 of retractable member 12 to move to retractable member 12 from the retracted position to the extended position, overcoming the elastic force of said spring 26.

The set of guide and dynamic current collector 3 of the vehicle consists of, in addition, brush holder platforms 31 that project to side and side of the same one, between rod 19 and fin 4, in a position substantially parallel to the upper surfaces of contact of the electroconducting tracks 6*a*, 6*b*. In each one of said brush holder platforms 31 is arranged means for fixing the respective brush 32 and for connecting it electrically to the motor. The rod 19 defines an outside annular ledge 33 and an outside cylindrical step 34 in its upper end, in whose cylindrical step 34 it is fixed, by elastic plug to pressure, a bracket 35, being caught, between said bracket 35 and said annular ledge 33, a zone of the frame of the vehicle next to a hole in which is inserted the rod 19 so that said one, with the fin 4 and the brush holders 30, can turn freely. The configurations of the bracket 35 and step 34 of rod 19 are such that said bracket 35 cannot turn with respect to the rod 19. Advantageously, the bracket 35 has a lever 36 (FIG. 3) linked to the frame through elastic means (not shown) that, in the absence of other forces, for example when the vehicle is outside of the track, they tend to locate the set of guide and dynamic current collector 3 with the fin 4 positioned according to the lengthwise direction of the vehicle.

Referring to FIG. 10, it is shown an example of application of the deviation system in agreement with the first example of the embodiment of the present invention. It is a portion of track 1 that in its ends, as it is conventional, includes means (not shown) for mechanical connection with other portions of track to form a circuit, which is generally a closed circuit. Said portion of track 1 consists of a track surface and first and second guide channels 80, 90, by which can circulate one or more vehicles provided with a guide set and dynamic current collector 3 like the described in relation to the FIGS. 3 to 7C, moving in the direction of arrows D. The first guide channel 80 consists of one of the previously mentioned branching forks 87 from which start to first and second branches 82*a*, 82*b*. The mentioned first branch 82*a* is a prolongation of the corresponding first guide channel 80, whereas said second branch 82*b* comes together with the second guide channel 90 in a confluence 93. To side and side of the first and second guide channels 80, 90 and of said first and second branches 82*a*, 82*b* are arranged respective electroconducting tracks 75*a*, 75*b*. In zones of said electroconducting tracks 75*a*, 75*b* close to branching fork 87 and confluence 93 exist interruptions 88, 98 with the aim to prevent the contact among them and thus to avoid short circuits due to the opposed electrical polarity that have the electroconducting tracks 75*a*, 75*b* adjacent to the branching fork 87 and to the entrance of confluence 93. The electroconducting tracks 75*a*, 75*b* finish, as also it is conventional, in the edges of the portion of the track 1 with electrical connection means 84 to the electroconducting tracks of other portions of track. In branching fork 87 it is a set of the switch point 9, arm 11 and cam profile 14, like the one of previously described body 38 in relation to the FIGS. 1A, 1B and 2. With said configuration, a vehicle that initially moves by the first guide channel 80 can, optionally, follow by the first branch 82*a* or to change to the second guide channel 90 through the second branch 82*b* with the intervention of a change of the switch point 9 by the action of a retractable member 19 of the set of guide and dynamic current collector 3 of the vehicle. In FIG. 10 switch point 9 is in its first position. Although it has not been shown, it is possible to add a portion of analogous track 1 to the one of FIG. 10 but with the inverse deviation, arranged to pass from the second guide 90 to the first guide 80. In said case, the body 38 would present a mirror symmetry with respect to the body 38 shown in the FIGS. 1A, 1B and 2.

FIG. 11 is another application of the first example of the embodiment of the present invention. It is also a portion of track 1 provided to be connected mechanically with other portions of track to form a circuit and that consists of a track surface with first and second guide channels 50, 60. Nevertheless here each one of the first and second guide channels 50, 60 includes one of said branching forks 57, 67 from which start first branches 52*a*, 62*a* and second branches 52*b*, 62*b*. The first branches 52*a*, 62*a* are prolongation of the corresponding ones first and second guide channels 50, 60 whereas the second branch 52*b* of the first guide channel 50 comes together more ahead with the first branch 62*a* of the second guide channel 60 in a confluence 63 and the second branch 62*b* of the second guide channel 60 come together more ahead with the first branch 52*a* of the first guide channel 60 in a confluence 53. In a middle zone it takes place a crossing 51 of the second branches 52*b*, 62*b*. To side and side of the first and second guide channels 50, 60 and of each one of said first and second branches 52*a*, 62*a*; 52*b*, 62*b* there are arranged respective electroconducting tracks 70*a*, 70*b*. Also here, and by the same reasons exposed above, there are interruptions 58, 59, 68 in zones of said electroconducting tracks 70*a*, 70*b* next to branching forks 57, 67, confluences 53, 63 and, in addition, in crossing 51. The same as in the example of FIG. 8, the electroconducting tracks 70*a*, 70*b* finish in the edges of the portion of track 1 with electrical connection means 54 to electroconducting tracks of other portions of track. In both branching forks 57, 67 are arranged individual bodies 38 part of the switch point 9, the arm 11 and the cam profile 14 in agreement with the present invention. In FIG. 11, switch point 9 of the first branching fork 57 is in its first position and the one of the second branching fork 67 in its second position. Obviously, the body 38 of the second branching fork 67 has a mirror symmetry with respect to the body 38 of the first branching fork 57, which is like the one shown in the FIGS. 1A, 1B, 2. With said configuration, any vehicle that initially moves by the first or second guide channel 80, 90 can, optionally, follow by corresponding first or second branch 82*a*, 92*a*, or change to the second or first guide channel 90, 80 through the corresponding second branch 82*b*, 92*b* with the intervention of a change of the respective switch point 9 actuated by the retractable member 19 of the set of guide and dynamic current collector 3 of the corresponding vehicle.

In the first example of the embodiment described above, the vehicles have a small interruption of power supply in the mentioned interruptions 8, 58, 59, 68, 88, 98 of the electroconducting tracks 6*a*, 6*b*; 70*a*, 70*b*; 75*a*, 75*b* that overcome by inertia almost without experimenting a loss of speed. Nevertheless, in agreement with a second example of the embodiment of the invention, means have been foreseen to avoid that the vehicles have said interruptions of power supply in the interruptions 8, 58, 59, 68, 88, 98 of the electroconducting tracks 6*a*, 6*b*; 70*a*, 70*b*; 75*a*, 75*b*.

Referring now to the FIGS. 5A, 5B, in them it is shown a track surface in which, like in the FIGS. 1A and 1B, is arranged a channel guide 2 with a branching fork 7 from which start first and second branches 2*a*, 2*b*. The guide channel 2 and first and second branches 2*a*, 2*b* are flanked by respective electroconducting tracks 6*a*, 6*b* connected to opposed polarities of a DC source, and in the zone of branching fork 7 it is arranged a body 38 provided with a switch point 9, an arm 11 and a lever arm 28. Nevertheless, in said second example of the embodiment, said switch point 9 includes electroconducting elements 9*a*, 9*b* (shown also in the FIGS. 6 to 8) connected to the opposed polarities of said DC source slightly projecting its lateral faces, whereas the fin 4 of the set of guide and dynamic current collector 3 in agreement with said second example of the embodiment of the invention consists of electrical contacts 4*a*, 4*b* (see the FIGS. 9A and 9B) arranged in their flanks and connected electrically to the motor to take feeing electrical current from at least one of said electroconducting elements 9*a*, 9*b* in the zone of branching fork 7 where at least one of the brushes 32 cannot make contact with a respective electroconducting track 6*a*, 6*b* due to said interruptions 8. Advantageously, said electrical contacts 4*a*, 4*b* of the fin 4 have connected upper prolongations with the brushes 32, which are connected to the motor.

It will be observed that the second branches 2*a*, 2*b* in the FIGS. 5A, 5B start to opposite sides that the branches 2*a*, 2*b* in the FIGS. 1A, 1B. This is immaterial since in both examples of the embodiment branching forks have been provided towards both sides using mirror symmetrical bodies 38, as they are show in the FIGS. 11 and 13.

As it is better shown in the FIGS. 7 and 8, preferably, at least one of the electroconducting elements 9*a* is retractable and is pushed towards its more projecting position by elastic means 5. Usually, said retractable electroconducting element 9*a* is only one and is placed in the side of the corresponding switch point 9 corresponding to the opposed side of the one side towards it is pushed by elastics means 10 connected to the lever arm 28 (in the drawings, corresponding to the side where the lever 28 is). The other electroconducting element 9*b* is fixed and is arranged in the opposite side. This is thus since the mentioned elastic means 10 will press the fixed electroconducting element 9*b* of the switch point 9 against the contact 4*b* of the fin 4 when said one is in the side towards which is pushed by elastic means 10 (FIG. 9B). In addition, if the second branch 2*b* is curved, it is preferred that elastic means 10 push the switch point 9 towards the same one, as is in the FIGS. 5A and 5B, and the centripetal force also collaborates in assuring the contact between fixed electroconducting element 9*b* of the switch point 9 and the contact 4*b* of the fin 4. On the contrary, in the first branch 2*a*, is the force of the elastic means 5 the one that assures the contact between the retractable electroconducting element 9*a* of the switch point 9 and the contact 4*a* of the fin 4.

As it is shown in the FIGS. 7 and 8, the electroconducting elements 9*a*, 9*b* are preferably made of a laminar material and present as contact zone a rim or an edge of a portion of said laminar material no parallel to the flank of the switch point 9. The retractable electroconducting element 9*a* has a bent portion 23 inserted in a gap 30 of the switch point 9 in which are placed said elastic means 5 in the form of elastic tongue-pieces 5 integrals of the switch point 9. Both electroconducting elements 9*a* are retained and superiorly covered by a cover 39 of dielectric material. For example, the cover has small projections 41 passed through holes 42 of the fixed electroconducting element 9*b* and inserted by pressure in holes 43 of the body 38 that includes the switch point 9. The electroconducting elements, retractable and fixed 9*a*, 9*b*, have respective tongue-pieces of connection 44, 45, shown respectively in the FIGS. 8 and 7.

In the FIG. 9A is shown the set of guide and dynamic current collector 3 of the vehicle in interaction with the body 38 in the zone of branching fork 7 when retractable member 12 is in its retracted position in agreement with the second example of the embodiment. The cam profile 14 of the arm 11 has not made contact with the retractable member 12 and therefore the spring 10 connected to the lever 28 keeps pressed the body 38 towards the left (according to the figure) of the fin 4. It will be observed that while the brush 32 of the right (according to the figure) makes electrical contact with electroconducting track 6*a*, brush 32 of the left (according to the figure) is over the cover 39, of dielectric material, of the switch point 9. Nevertheless, the electrical contact in said left side (according to the figure) takes place between the electrical contact 4*b* of the fin 4 and the retractable electroconducting element 9*a* of the switch point 9, which is pressed by the elastic tongue-pieces 5.

In the FIG. 9B, the cam profile 14 of the arm 11 has made contact with the retractable member 12 and therefore the body 38 has been moved and is kept to the left (according to the figure) of the fin 4 by guide profile 16 of the one of the switch point 9 against the force of the spring 10 connected to the lever 28. It will be observed that while brush 32 of the left (according to the figure) makes electrical contact with the electroconducting route 6*b*, brush 32 of the right (according to the figure) is on the cover 39, of dielectric material, of the switch point 9. Nevertheless, the electrical contact in said right side (according to the figure) takes place between the electrical contact 4*a* of the fin 4 and the fixed electroconducting element 9*b* of the switch point 9, which is pressed by the spring 10 via switch point 9.

Finally, in the FIGS. 12 and 13 are examples of application of the system of deviation in agreement with the second example of the embodiment of the present invention.

The example of FIG. 12 shows a portion of track 1 provided with identical elements that the ones shown in FIG. 10, except the bodies 38, which integrate an arm 11 and a switch point 9 provided with electroconducting elements 9*a*, 9*b*, and are placed as well as in the branching fork 87 as in the confluence 93, reason why said portion of track 1 is reversible, that is to say, it is appropriate in order that the vehicles circulate in anyone of two-track traffic.

In the example of FIG. 13 is another portion of track 1 provided with identical elements that the ones shown in FIG. 11, except the bodies 38, which integrate an arm 11 and a switch point 9 provided with electroconducting elements 9*a*, 9*b*, and are placed as well as in each one of the branching forks (57, 67) as in each one of the confluences (53, 63), reason why said portion of track 1 is reversible.

The previous examples of the embodiment merely have an illustrated and not limitative character of the scope of the present invention, which is defined by the attached claims.

The invention claimed is:

1. A track for a toy vehicle, comprising:

a base;

a guide groove formed in the base, the guide groove being configured to receive a guide follower of a toy vehicle, wherein the guide groove includes at least one fork with first and second branches such that a toy vehicle guided by the guide groove could follow two different paths;

a switch arm that is pivotally mounted on the base at the fork in the guide groove, wherein the switch arm is moveable between a first position at which it will guide a toy vehicle along the first branch of the fork and a second position at which it will guide a toy vehicle along the second branch of the fork, wherein the switch arm includes:

an elongated base with a pivot hole at a first end, and a cam profile on a second opposite end that can slidingly engage a retractable switch member of a toy vehicle traveling along the guide groove to cause the switch arm to move from the first position to the second position; and a guide surface that protrudes upward from the base, wherein the guide surface extends from a position adjacent the pivot hole along less than the total length of the base; and a biasing member mounted on the base that biases the switch arm into the first position.

2. The track of claim 1, wherein the switch arm includes a lever arm that extends from a side of the switch arm, and wherein the biasing member comprises a spring having a first end attached to the lever arm and a second end attached to the base.

3. The track of claim 1, wherein the switch arm is mounted on the base under the fork in the guide groove such that when a toy vehicle passes along the guide groove, a bottom surface of a guide follower of the toy vehicle will pass over the base.

4. The track of claim 3, wherein when the switch arm is located in the first position, the guide surface of the switch arm bridges an apex of the fork in the guide groove with a first sidewall of an upstream portion of the guide groove such that the guide surface will guide a guide follower of a toy vehicle traveling along the guide groove along the first branch of the fork in the guide groove.

5. The track of claim 4, wherein when the switch arm is located in the second position, the guide surface of the switch arm bridges the apex of the fork with a second sidewall of an upstream portion of the guide groove such that the guide surface will guide a guide follower of a toy vehicle traveling along the guide groove along the second branch of the fork in the guide groove.

6. The track of claim 1, wherein the switch arm is mounted on the track such that a toy vehicle traveling along the guide groove will pass the cam profile of the switch arm before passing a leading edge of the guide surface.

7. The track of claim 1, further comprising first and second electrical conductors located on a top surface of base and on first and second sides, respectively, of the guide groove, wherein the first and second electrical conductors are configured to supply electricity to brushes of a toy vehicle traveling along the guide groove.

8. The track of claim 7, wherein the switch arm further comprises:

a first bridging electrical conductor extending along a first side of the guide surface of the switch arm; and a second bridging electrical conductor extending along a second side of the guide surface of the switch arm, wherein the first and second bridging electrical connectors are configured to supply electricity to brushes on a guide follower of a toy vehicle moving along the guide groove.

9. The track of claim 8, wherein the first electrical conductor is movably mounted on the switch arm, and wherein the first electrical conductor is biased into a position at which it that extends away from the first side of the guide surface of the switch arm.

10. The track of claim 7, further comprising a transmitter that transmits a digital control signal through the first and second electrical conductors.

11. The track of claim 10, wherein the transmitter sends a digital control signal that includes a vehicle identification code.

12. The track of claim 10, wherein the transmitter sends a digital control signal that includes a speed control command.

13. The track of claim 10, wherein the transmitter sends a digital control signal that include a switching command.

* * * * *